United States Patent [19]

Bresler

[11] 4,037,322

[45] July 26, 1977

[54] RAZOR ADAPTED FOR SURGICAL PREPARATION

[76] Inventor: Albert E. Bresler, 14314 Chase St., Panorama City, Calif. 91402

[21] Appl. No.: 514,489

[22] Filed: Oct. 15, 1974

[51] Int. Cl.[2] ..... B26B 21/10; B26B 21/12

[52] U.S. Cl. ..... 30/53; 30/30

[58] Field of Search ..... 30/30, 31, 47, 53–55, 30/62–64, 81, 82, 346.56, 78

[56] References Cited

U.S. PATENT DOCUMENTS

| | | | |
|---|---|---|---|
| 1,003,749 | 9/1911 | Jannert | 30/78 |
| 1,365,176 | 1/1921 | Knudtson | 30/54 |
| 1,672,310 | 6/1928 | Edgar | 30/54 |
| 2,530,918 | 11/1950 | Taylor | 30/30 |
| 2,650,421 | 9/1953 | Wietzel | 30/30 |
| 3,772,778 | 11/1973 | Ishida | 30/53 |
| D159,994 | 9/1950 | Lee | 30/30 X |

FOREIGN PATENT DOCUMENTS

| | | | |
|---|---|---|---|
| 22,597 | 11/1917 | Denmark | 30/30 |
| 25,128 | 9/1922 | France | 30/30 |

*Primary Examiner*—Gary L. Smith
*Attorney, Agent, or Firm*—Wm. Jacquet Gribble

[57] ABSTRACT

A light weight handle and head carry a blade with a discontinuous cutting edge. The handle extends at an acute angle to the extent of the blade edge. The handle increases in girth from the head to its free end. The head is slotted to receive the blade in a carrier or guard with a "V"-shaped cross-section. The trough of the "V" is perforated to define slim bands that cross the edge of the blade. The perforate edges are contoured to eliminate drag on the skin and hair of the user. The longitudinal axis of the handle is coplanar with the blade and the handle configuration enables the user to rotate the razor head for ease in shaving difficult areas. The carrier interrupts the skin contact of the cutting edge to prevent slicing the skin.

8 Claims, 33 Drawing Figures

Fig. 2.
Fig. 1.
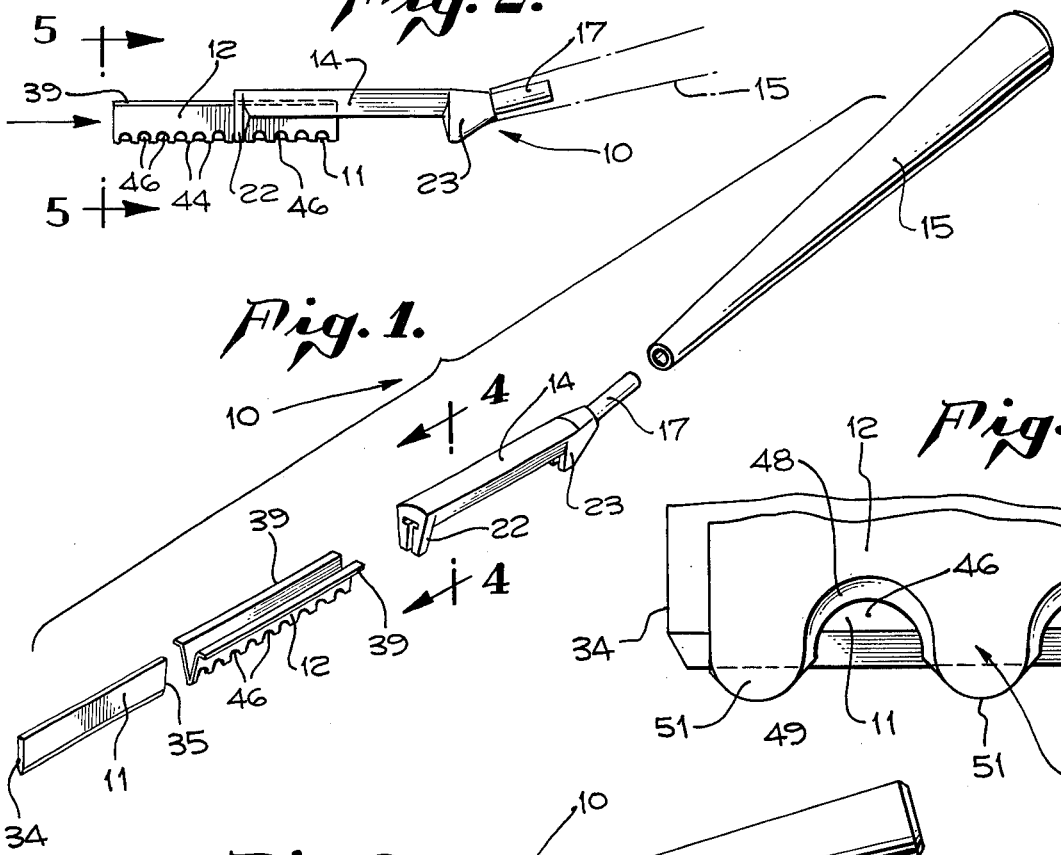
Fig. 6.
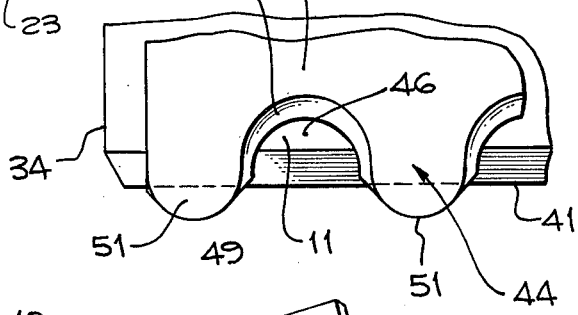
Fig. 3.
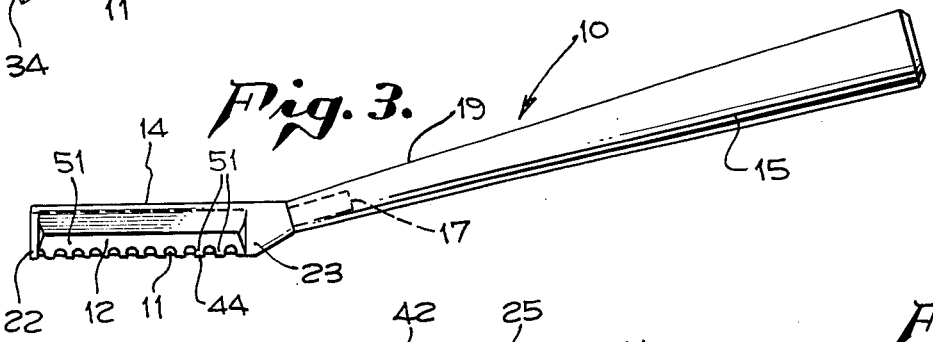
Fig. 4.
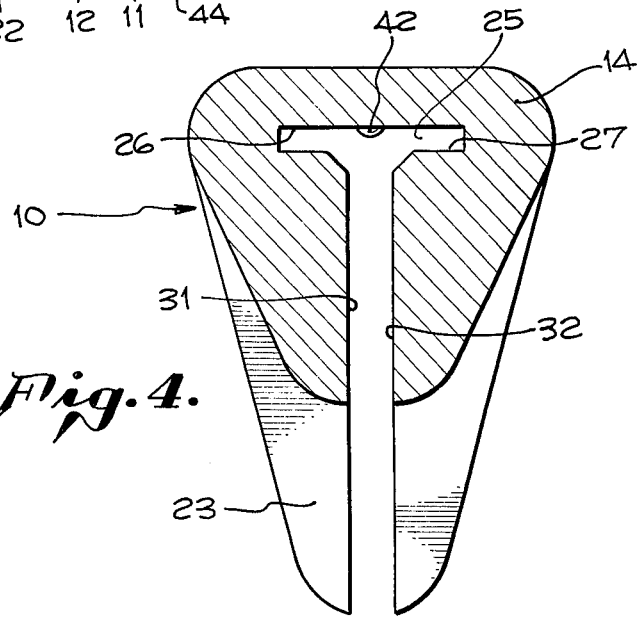
Fig. 5.
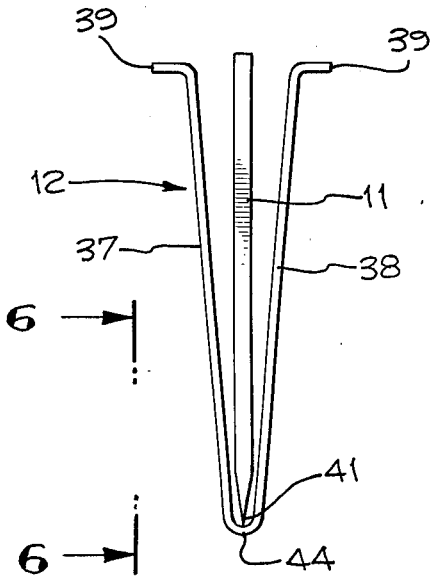

11
14
10
12
15
55
9

62
62

76
75
71
74

58
59
41a
61
15a
9

15c
17a 11
76
72
74
15b
71
11

88
94
15d
96
75
97

13
88
15c
72a
71a
81
13

103
106
104
107

15
15d
88
89
41b
91
98
15

118
115
119
116

17
15e
106
108
17
112

19
15f
113
19
112

121
10
129
127
128

121
10a
10
121
123
120
124

RAZOR ADAPTED FOR SURGICAL PREPARATION

BACKGROUND OF THE INVENTION

Orginally razors were knives with special handles. Cutting of the user was progressively dimished by various devices and combinations most based upon barring whole-blade contact with the user's skin. Razors became smaller, and somewhat less awkward. Thus, various "guards" were developed on the "rake" principal, culminating in the well-known small safety razor with slotted guard bar. Also, smooth bars extending the length of the blade edge were tried, spaced from the blade an interval great enough to allow hair entry to the blade, much like a carpenter's plane in operation. All types of razors had drawbacks of safety of clumsyness, and recent attempts to solve these problems have centered about simple ways to make discontinuous the cutting edge of the blade itself, instead of using rakes or bars removed from the blade edge, as in the "planning" concept. One such attempt wraps the blade in fine wire. Another uses holed adhesive foil. These, among others, approach the solution to pre-surgical and other medical needs of a special nature, but fall short of accomplishment. Exemplifying the area of the invention are the following United States Letters Patent:

| Patent No. | Inventor | Date of Issue |
|---|---|---|
| 1,028,461 | Helyn | 1910 |
| 1,035,548 | Dickenson | 1912 |
| 1,579,577 | Thompson | 1926 |
| 1,823,808 | Thompson | 1931 |
| 1,846,622 | Thompson | 1932 |
| 3,263,330 | Farrar | 1966 |
| 3,505,734 | Iten | 1970 |

However, all have failed to meet the strict requirements for such precise performance as desired in medical pre-operational preparation, such as scalp shaving, for instance, where a hidden pimple or growth may be cut into when using a conventional "T" handle razor, both because such a razor blocks vision of hair area being shaved and because the razor is not responsive to fine manipulation however skillful the user. In shaving tender or infected skin, including burned and broken bone areas, pain response or stimulation of nerve endings is intensified to a marked degree. Added sensitivity is encountered when fine hairs are engaged by the edges and other surfaces of conventional razors. Microscopic examination of shaving operations has shown that these fine hairs in a burn or other area may either be pinched, caught or displaced around the razor guard edges, particularly if the razor is moved obliquely, increasing patient discomfort.

The invention, therefore, has as an object the presentation of a razor affording scalpel-like control in shaving difficult areas of the head and torso, such as scalp, anal and pubic areas.

Another object of the invention is to provide a razor with a slender blade and safety guard for better visual control.

An important object of the invention is to provide a razor having a long, slender handle increasing in girth away from the blade to be rotatable with the thumb and index finger to give dexterous control in pinpoint areas of the nostril, the ear cavity and pubic areas in the same degree a surgeon can control a scalpel.

SUMMARY OF THE INVENTION

Therefore, the invention contemplates a razor which comprises a blade head with a handle extending from the head in the plane of the blade. The longitudinal axis of the elongate handle makes an acute angle with the blade edge. A slot in the blade head removably receives a blade, with head side portions mounting the ends of the blade. A guard associated with the head extends along the edge of the blade, which may be a conventional safety razor blade. Registry means on the head locate the blade precisely.

In a preferred embodiment the guard is a carrier for the blade and has a thin folded plurality of portions defining perforations at the blade cutting edge so the blade edge is discontinuous. The walls defining the perforations are chamfered adjacent the blade edge and may be highly polished to reduce drag. The chamfering may take the form of double curvature of the perforation walls, for this configuration has been proved to improve materially the razor performance, adding to the range of dexterity of the invention.

To lower the costs of production the blade head and the handle may be separately formed as injection molded plastic parts and then joined in a single assembly ready to receive the removable blade and carrier.

These and other advantages of the invention are apparent from the following detailed description and accompanying drawing.

BRIEF DESCRIPTION OF THE DRAWING

FIG. 1 is an exploded perspective view of a razor in accordance with the invention;

FIG. 2 is a schematic elevational view showing the razor of FIG. 1 being loaded with an assembled blade and carrier or guard;

FIG. 3 is an elevational view of the razor of FIG. 1 assembled for use;

FIG. 4 is a sectional elevation to an enlarged scale of the razor head, taken along line 4—4 of FIG. 1;

FIG. 5 is an enlarged end elevation of the blade and carrier taken along line 5—5 of FIG. 2;

FIG. 6 is a fragmentary enlarged elevation taken along line 6—6 of FIG. 5;

In differing views like parts are indentified by the same reference characters.

DESCRIPTION OF THE PREFERRED EMBODIMENTS

Figures 7, 8, 9, 10, 11, 12, 13, 14, 15, 16, 17, 18, 19, 20, 21:
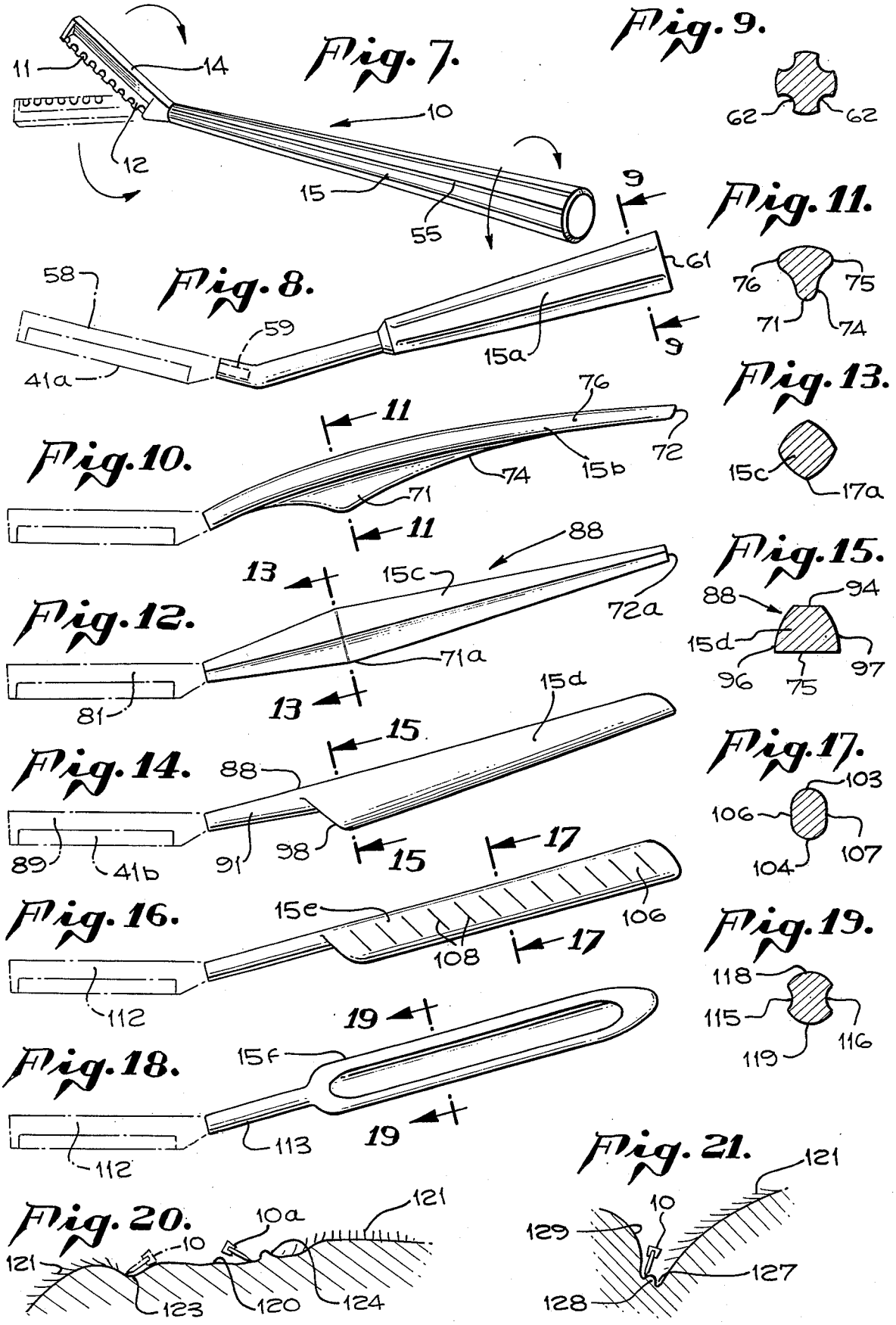
FIG. 7 is a schematic perspective view of the embodiment of FIG. 1 illustrating the degree of digital control.
FIG. 8 is an elevational view of an alternate embodiment of the invention having an alternate handle configuration.
FIG. 9 is a sectional elevation taken along line 9—9 of FIG. 8.
FIGS. 10, 12, 14, 16 and 18 are elevational views of further alternate embodiments, FIGS. 11, 13, 15, 17 and 19 being respective transverse sectional views thereof.
FIG. 20 is a schematic representation of a razor in accordance with the invention in use on an irregular skin surface.
FIG. 21 is similar to FIG. 20, showing an invaginated surface.

The surgical preparation razor 10 of FIGS. 1 through 7 comprises a blade 11, a carrier or guard 12, a blade head 14 and a slender handle 15. The handle is conical in configuration, enlarging in girth away from its joinder with the blade head. Joinder is by means of a cylindrical rod 17 fixed to, or a part of, the blade head 14 and extending longitudinally therefrom at an angle to the blade edge, as is shown in FIGS. 2 and 3. Handle 15 has a bore 18 in its small end 19 that extends along the longitudinal axis of the elongate handle such that union of the handle and blade head fixes the handle with its axis at an acute angle to the blade edge. Blade and axis are in the same plane. Blade 11 may be a conventional single-edged injector blade, but, as the further disclosure shows, other blades are within the contemplation of the invention.

The blade head has a body portion 21 to which the rod 17 is affixed. Spaced arms 22, 23 extend from the body portion at opposite ends thereof so that the blade head has a generally "U" shaped configuration best seen in FIG. 2. In FIGS. 1 and 4 the blade head is seen to have pairs of parallel walls defining slots which are mutually perpendicular, upper slot 25 being defined by upper and lower walls 26, 27, respectively, while vertical slot 29 is defined by walls 31, 32. Walls 31, 32 extend through arm 22 and into arm 23 which are spaced longitudinally such that the ends 34, 35 of the blade lodge in the arms, with the sharp corners of the blade edge extremes masked or covered by the arms.

In order to have a discontinuous blade edge to prevent slicing of skin, razor 10 of FIGS. 1–7 has a blade guard 12 which is a folded metallic blade carrier. Guard 12 comprises folded sides 37, 38 each having upper transverse wings 39 extending the length of the carrier. The wings fit upper slot 25 which has a transverse width calculated to bring the folded sides 37, 38 into contact with the blade 11 carried in the carrier. In FIG. 1 the blade is outside the carrier, while in FIG. 2 the united blade and carrier are being inserted into the blade head.

In FIG. 5 the united blade and carrier or guard are shown. The cutting edge 41 of the blade rests on the perforated fold of the carrier. The opposite edge of the blade extends beyond the wings 39 of the carrier. As the blade and carrier are inserted into the blade head, the wings and sides of the carrier are moved inwardly against the blade, which contacts registry bead 42 of upper slot 25 to align the blade properly with respect to the head and the perforate fold 44 of the carrier. The carrier is preferably made from half-hard stainless steel strip 0.006 inches thick, providing a resilient material to assume the "T" shape of the slot from the "V" shape of the pre-insertion condition.

The blade 11 and the carrier are inserted as shown in FIG. 2 after being united as shown in FIG. 5. In FIG. 3 the razor is shown ready for use, the handle and head having previously joined at the rod and bore. Solvent welding or other suitable fixing techniques hold the two parts together.

Turning now to FIG. 6, the fragmentarily shown blade and carrier are shown in the orientation they bear to each other when in use, blade edge 41 in contact with carrier fold 44. The fold has a plurality of perforations 46 which are each defined by contoured walls 48, 49. The blade edge 41 is exposed by the perforations and interrupted by the thin bands 51 between perforations. Walls 48 on each side of the carrier are chamfered along their arcuate extent to lessen drag in contact with hair or sensitive skin areas, the less abrupt the encounter the less the drag.

The folded portion of the bands are also contoured as seen in FIG. 6 so that each perforation affords an angled slope lead and radius up from the razor's edge. The countour is preferably achieved by coining the folded-edge perforation walls prior to folding the carrier. Special sanding and polishing treatment follows the coining operation to smooth the transition areas between band and perforation walls. A glide surface at each perforation of the carrier edge of optimum efficiency for a soft shave stroke is thus afforded, even for shave strokes drawn over an oblique path, where previous devices have failed.

Prior to folding the slots in the center of the carrier blank are approximately 0.110 inches long and spaced on 0.100 inches centers. The chamfer is about 35° after coining, and all edges of the carrier perforations are rounded slightly by the polishing process. In addition, the thin bands 44 are contoured from the point of contact with the blade cutting edge to the fold line in a unique radius bevel eliminating edges between the band crown 51 and the cutting edge of the blade.

The razor of FIG. 1 thus has a smooth action not heretofore obtained. In addition, as shown in FIG. 7, the combination of the slim, manipulatable handle set at an angle to the blade edge affords scalpel-like control never possible before the invention herein. Simple rotation of the handle as shown by the arrows 53, 54 in FIG. 7 alters the attitude of the blade to the surface to adjust to skin contours, protrusions or wrinkles, all within the visual purview of the razor operator at all times because of the orientation of the handle axis to the blade edge.

An added advantage of the razor of the invention is that the angular handle attitude avoids any the contact of the handle with the surface traversed by the blade, it being most unlikely that the blade edge and the handle can touch the operative surface together.

While the handle may have several grip-enhancing elements, the handle of FIG. 7 has longitudinal grooves 55. Other grip-enhancing elements are depicted in FIGS. 8 though 19, with the embodiment of FIG. 8 also proferring an alternate handle adapted to unite with a blade head 58 from which a cylindrical rod 59 projects in a line parallel to the blade edge 41A, shown in phantom lines. The handle 15A of FIG. 8 has a small shank adjacent the blade head set at an angle to the longitudinal axis of the handle, such that the general run of the handle in the plane of the blade is at an acute angle to the blade edge. As in the prevention of slicing elements previously described, the blade of FIG. 8 may reside in a guard or carrier which effects a discontinuous blade edge.

The handle 15A increases in girth toward its end 61 remote from the blade. Instead of being fluted, the handle 15A has a cruciform cross-section, as seen in FIG. 9. For some the deeper resultant grooves 62 afford a grip conducive to better manipulation.

A further alternate handle 15B increases rapidly in girth away from the blade head, resulting in a mid-handle prominance 71 and then tapers oppositely to a remote small end 72. The prominence 71 is a diamond-shaped in crossection, as shown in FIG. 11. Three rounded ridges 74, 75, 76 extend the length of the handle and aid handle manipulation in the manner shown in FIG. 7, such that the embodiment of FIG. 10 is equally adapted to precise, smooth pre-operative use.

FIG. 12 shows in phantom lines a blade head 81 like that FIG. 1 joined with a handle 15C which attaches to the head in the same manner as the handle of FIG. 1, but differs from the handle 15 thereof in having a swift increase in girth away from the head resulting in a mid-handle prominence 71A that is diamond-shaped in cross section (FIG. 13). Four spaced edges 83 –86 thus extend the length of the handle 15C, which tapers to a remote small end 72A.

Another alternate embodiment is illustrated in FIGS. 14 and 15, wherein a razor 88 with a head like the head of FIG. 1 is joined with a handle 15D such that the handle axis and the blade are co-planar and the razor handle axis is at an acute angle to the blade edge 41B. Both blade and head are in broken lines.

Handle 15D increases in girth sharply away from the head, in a thick wedge extending from a slim cylinder shank 91 to which the head is attached as set forth above. The wedge portion 92 has a shape as shown in section in FIG. 15, with flat top and bottom surfaces 94, 95 respectively, joined by curved side surfaces 96, 97 to define the wedge. Again, four edges are afforded for gripping, with the added shoulder 98 a short distance from the head to give another manipulative surface.

The razor 101 of FIGS. 16 and 17 is similar to the razor of FIG. 14, but its handle 15E differs in having rounded top and bottom surfaces 103, 104 while the sides are flat at 106, 107. The sides 106, 107 may be serrated as indicated by slant lines 108.

The alternate embodiment of FIGS. 18 and 19 comprises a surgical razor 111 with a head 112 fixed to a cylindrical shank 113 of a handle 15F which increases abruptly in girth away from the head in a handle portion with dished or concave sides 115, 116 and round top and bottom surfaces 118, 119 respectively. Several elongate edges are thus afforded for a sure grip for a user's digits.

Each of the exemplary razors of FIGS. 8 through 19 offers the advantages of the invention of high visibility of the work are a immediate the blade, scalpel-like dexterity in handling and sure, safe and smooth accomplishment of shaving even the most difficult areas of head or body. For instance, in FIG. 20 razors 10 and 10A are shown in use on a skin area 120 with hairs 121 and shallow wrinkle 123 near a pimple eruption 124. Each illustrated skin condition is easily compensated for by the razor of the invention. The razor approach angle may be altered by a small rotation of the handle as shown in FIG. 7. Since visibility in the area of razor encounter is complete, the pimple may be avoided. The wrinkle is penetrable by the slim, small razor head with the handle extending at an angle to the blade edge, in the same way that a surgeon can manipulate a small scapel. Because the blade is discontinuous it will not slice the skin and the razor is therefore useable at more extreme angles obliquely than with conventional razors.

The razor 10 of FIG. 21 is shown approaching the bottom of a skin invagination 127 where a secondary skin ridge 128 must be avoided. It is visible past the shaved slope since the area of the head is always visible. The hairs 121 of the unshaved slope can be shaved by an inward stroke of the razor, with complete control thereof insuring against accidental damage to secondary ridge 128.

Figure 22:
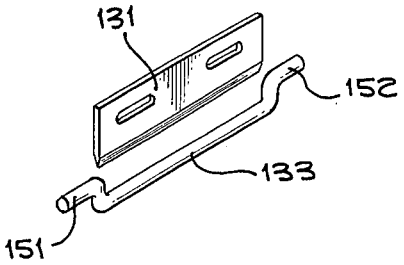
FIG. 22 is a perspective view of a blade and guard element of a further alternate embodiment of the invention.
Figure 27:
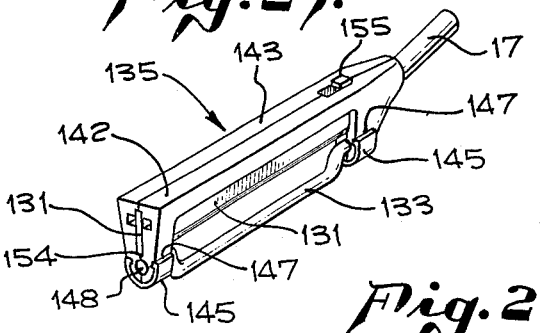
FIG. 27 is a perspective view of a razor head utilizing the blade and guard elements of FIG. 22.

A schematic perspective view in FIG. 22 illustrates a conventional removable blade 131 associated with a guard bar 133. The blade 131 may be combined with a blade head such as the head 135 of FIG. 27 with the guard 133 secured in the head adjacent the blade edge, but movable with respect to the edge. The head 135 is slotted longitudinally, walls 137, 138 defining a transverse slot and walls 139, 140 defining an intersecting vertical slot.

The head is preferably formed in obverse and reverse halves 142, 143 respectively, which are secured by half-moon clips 145 seated in grooves 147 in the outer ends of spaced arms 22, 23. Each arm has recesses like the recess 148 of arm 22 of FIG. 27 to receive crank ends 151, 152 of the guard bar 133. With the blade 131 in the vertical slot and the guard bar held in the recesses of the arms, the guard is free to assume a spaced relationship to the blade edge commensurate with the attitude of the blade of the skin.

The blade may register against the bottom wall 154 of the vertical slot in the blade head, urged into contact therewith by a registry bead (not shown) similar to that of FIG. 4 on the wall 26 of the horizontal slot. Bottom registry is needed in the emnbodiment of FIG. 27 because the guard bar 133 does not carry the blade 131. The blade is expelled by movement of top lever 155.

Other means of blade registry are shown in FIGS. 23 through 26 and 29. The blade 158 of FIGS. 23 and 24 comprises a blade body 159 with aligned openings 161, 162 (which may be conventional) into which cylindrical beads 164, 165 are pressed. The beads project on each face of the blade, affording registry means in the vertical slot and the horizontal slot to locate the blade with respect to the guard bar 133 of a head such as head 135, where the blade body is positioned by the vertical slot and the beads in the horizontal slot give registry with respect to the bar.

Figure 23:
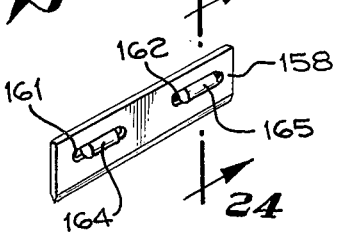
FIG. 23 is a perspective view of an alternate blade element.
Figure 24:
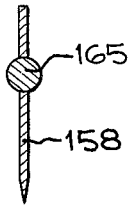
FIG. 24 is a sectional elevation taken along line 24—24 of FIG. 23.
Figure 28:
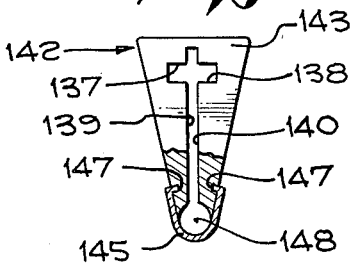
FIG. 28 is an end view, partly in section, of the blade head of FIG. 27.
Figure 25:
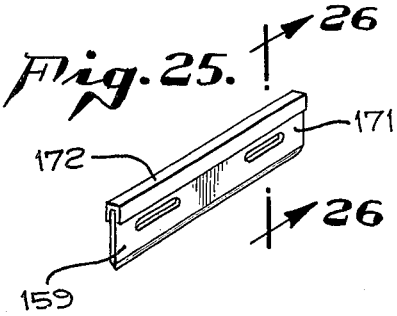
FIG. 25 is a perspective view of a still further alternate blade element.
Figure 26:
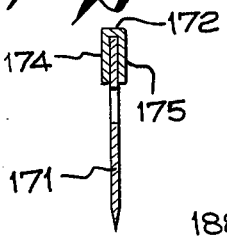
FIG. 26 is a sectional elevation taken along line 26—26 of FIG. 25.

FIGS. 25 and 26 show an alternate blade similar in function to the blade 158 of FIG. 23. A blade body 159 of a blade 171 is capped by a strip having a top 172 and sides 174, 175, each extending the full width of the blade body. It can be appreciated that the cap strip of 171 acts in the same way as the beads 161, 162 of the blade 158 to register the blade within the blade head.

Figure 29:
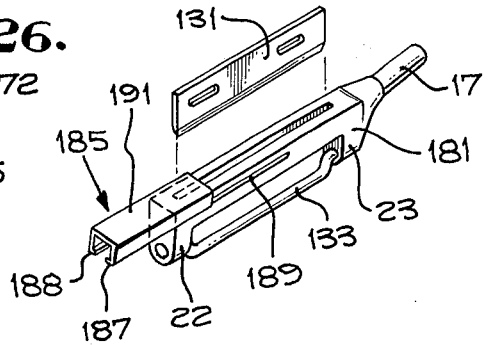
FIG. 29 is an exploded perspective view of a further alternate embodiment of the invention.

FIG. 29 shows a blade head 181 similar in construction to the previously described heads except that it has only a vertical slot 183 to receive and locate the blade 131. Like the previously described heads, head 181 has a body with arms 22, 23 and a rod 17 extending from arm 23 at an acute angle to the blade edge 41. The blade edge is registered with respect to the guard bar 133 by the bottom walls (not shown) of slot 183, restrained in that contact by a retainer slide 185. The slide has inwardly projecting ribs 187, 188 that ride in longitudinal grooves 189 on each side of the blade head 181. The grooves closely fit the ribs so that the ribs of retainer slide 185 remain in place, holding the slide over the blade such that the under side of the slider top 191 contacts the blade 131, holding the blade against the bottom wall of the vertical slot.

In each of the embodiments of FIGS. 23 through 29 a razor is provided in which a removable blade is held in relationship to a guard bar which adjusts to the attitude of the blade with respect to the skin being shaved and which is capable of quick, sure maneuverability because of the slimness of the blade head, the handle attitude with respect to the blade edge and the high visual contact with the area being shaved made possible by these factors and combination of elements.

Figure 30:
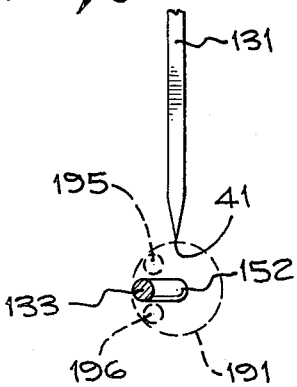
FIGS. 30 through 33 are schematic elevations illustrating differing shaving positions of the embodiments of FIGS. 22—29.
Figure 31:
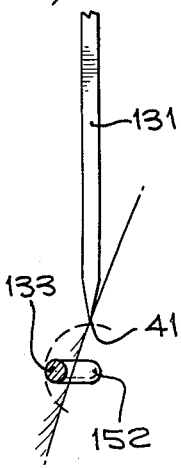
Figure 32:
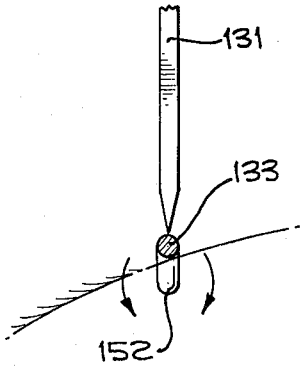
Figure 33:
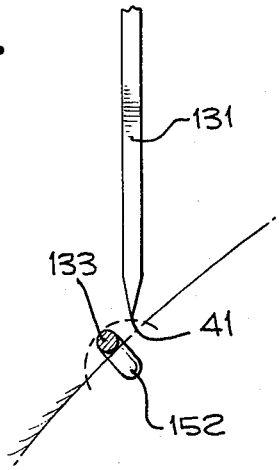

The adaptation to various blade orientations with respect to the skin is schematically illustrated in FIGS. 30 through 33. In FIG. 30 the blade 131 and its edge are shown, with the circle of adjustment of the guard bar 133 indicated by broken line circle 193, alternate positions of the bar being indicated in dotted lines at 195 and 196. In FIG. 31 the blade attitude to the skin is about 45 degrees, leaving a distance of about 0.125 inches from the blade edge to the point of bar contact with the skin. In FIG. 33 the blade angle is changed, and the interval between the blade edge 41 and the bar contact point is less, say about 0.090 inches.

When the blade is perpendicular to the skin the bar aproximates contact with the blade edge, precluding any slicing of the skin. It can be appreciated that each change in blade and head attitude moves the guard bar with respect to the blade edge. Therefore, the razor is infinitely adjustable with regard to edge and guard bar relevant spacing. However, the invention does not preclude added means for limiting the arc of the bar to those positions commonly utilized or found best for the particular use.

While the number of embodiments of the invention disclosed herein are plentiful, the scope of the invention is not exhausted thereby. Many modifications and changes within the scope of the invention will occur to those skilled in the particular art. It is therefore desired that the invention be measured by the appended claims, rather than by the illustrative disclosure made herein.

I claim

1. In a razor having a removable blade with registry means, the combination comprising a blade head, a top bar on said blade head, a front piece extending from the top bar, a rear piece extending from said top bar spaced from said front piece, walls in the top bar and end front and rear pieces defining blade-receiving slots; a blade carrier adapted to fit the blade-receiving slots, spaced walls on said carrier adapted to embrace the blade, slim bands on the carrier joining said spaced walls and adapted to cross the blade edge to interrupt the cutting edge exposure to the user; a handle extending from the rear piece, the central longitudinal axis of said handle extending in the plane of the blade at an acute angle to the cutting edge, said handle increasing in girth away from the end piece.

2. A razor in accordance with claim 1 wherein the slim bands are defined by chamfered walls where said walls pass over the blade edge.

3. A razor in accordance with claim 1 wherein the slim bands are defined by chamfered and coined walls having compound curvatures in the area of the bands traversing the edge of the blade.

4. A razor comprising a blade head, a rigidly fixed handle extending from the blade head in the plane of the blade, said handle making an acute angle with the blade edge, walls in the blade head defining a slot adapted to receive removably a blade, a razor blade residing removably in the blade head slot, head means housing the ends of the blade, a blade carrier, parallel side walls on the carrier adapted to embrace the blade, a transverse wing on each carrier side wall, wing-receiving slots in the blade head, and a registry protrusion in the blade head slot adapted to engage an edge of the razor blade in the blade head slot.

5. A razor comprising a blade head, a rigidly fixed handle extending from the blade head in the plane of the blade, said handle making an acute angle with the blade edge, walls in the blade head defining a slot adapted to receive removably a blade, a razor blade residing removably in the slot, head means housing the ends of the blade, a cylindrical elongate guard bar, means mounting the guard bar parallel to the cutting edge of the blade, means for guiding the guard into parallel positions with the blade cutting edge on either side of the plane of the blade, first and second blade head portions, said handle being attached to one of said portions, grooves in said blade head in each blade head portion, and clips inserted in said grooves connecting between said portions.

6. A razor comprising a blade head, a ridigly fixed handle extending from the blade head in the plane of the blade, the head handle making an acute angle with the blade edge, walls in the blade head defining a slot adapted to removably receive a blade, head means housing the ends of the blade; means for guarding the cutting edge of the blade including a blade carrier, parallel side walls on the carrier adapted to replace the blade, means for registry of the blade in the slot, a carrier fold surrounding the blade cutting edge, and arcuate walls defining perforations in the carrier fold such that the cutting edge of the blade is discontinuous; and a razor blade residing removably in the blade head slot.

7. A razor in accordance with claim 6 wherein the arcuate walls of the perforations are chamfered.

8. A razor in accordance with claim 6 wherein the means for registry comprises a transverse wing on each carrier side wall, wing-receiving slots in the blade head, and a registry protrusion in the blade head slot adapted to engage an edge of the razor blade in the slot.

* * * * *